United States Patent [19]

Wise et al.

[11] 3,977,597

[45] Aug. 31, 1976

[54] ONE PIECE, TWO-WAY MAILER

[75] Inventors: Lester V. Wise, Old Westbury, N.Y.; Jimmie Neill, Hatboro, Pa.

[73] Assignee: Federal Business Products, Inc., New York, N.Y.

[22] Filed: Oct. 7, 1975

[21] Appl. No.: 620,323

[52] U.S. Cl. ..... 229/73; 229/92.1; 282/25

[51] Int. Cl.[2] ..... B65D 27/06

[58] Field of Search ..... 229/73, 92.1, 92.3, 229/92.5, 92.7, 70; 282/25

[56] References Cited

UNITED STATES PATENTS

| | | | |
|---|---|---|---|
| 2,069,602 | 2/1937 | Davis | 229/92.3 |
| 2,355,348 | 8/1944 | Welliver et al. | 229/73 |
| 2,402,821 | 6/1946 | Kosteling | 229/92.1 X |
| 2,928,583 | 3/1960 | Law | 229/73 |
| 3,111,336 | 11/1963 | Schumacher | 282/25 |
| 3,131,854 | 5/1964 | Deutschmeister | 229/73 |
| 3,133,752 | 5/1964 | Schumacher | 282/25 |
| 3,197,121 | 7/1965 | Hayes, Jr. | 229/92.1 |

*Primary Examiner*—Stephen P. Garbe

[57] ABSTRACT

A two-way mailer assembly making it possible for a company to render a statement of charges to a customer and for the customer to remit. The assembly is created from a single paper blank which is perforated to create four panels, the panels being so folded and adhered to each other as to define forwarding and return envelopes as well as a statement and a return stub to accompany payment thereof.

9 Claims, 7 Drawing Figures

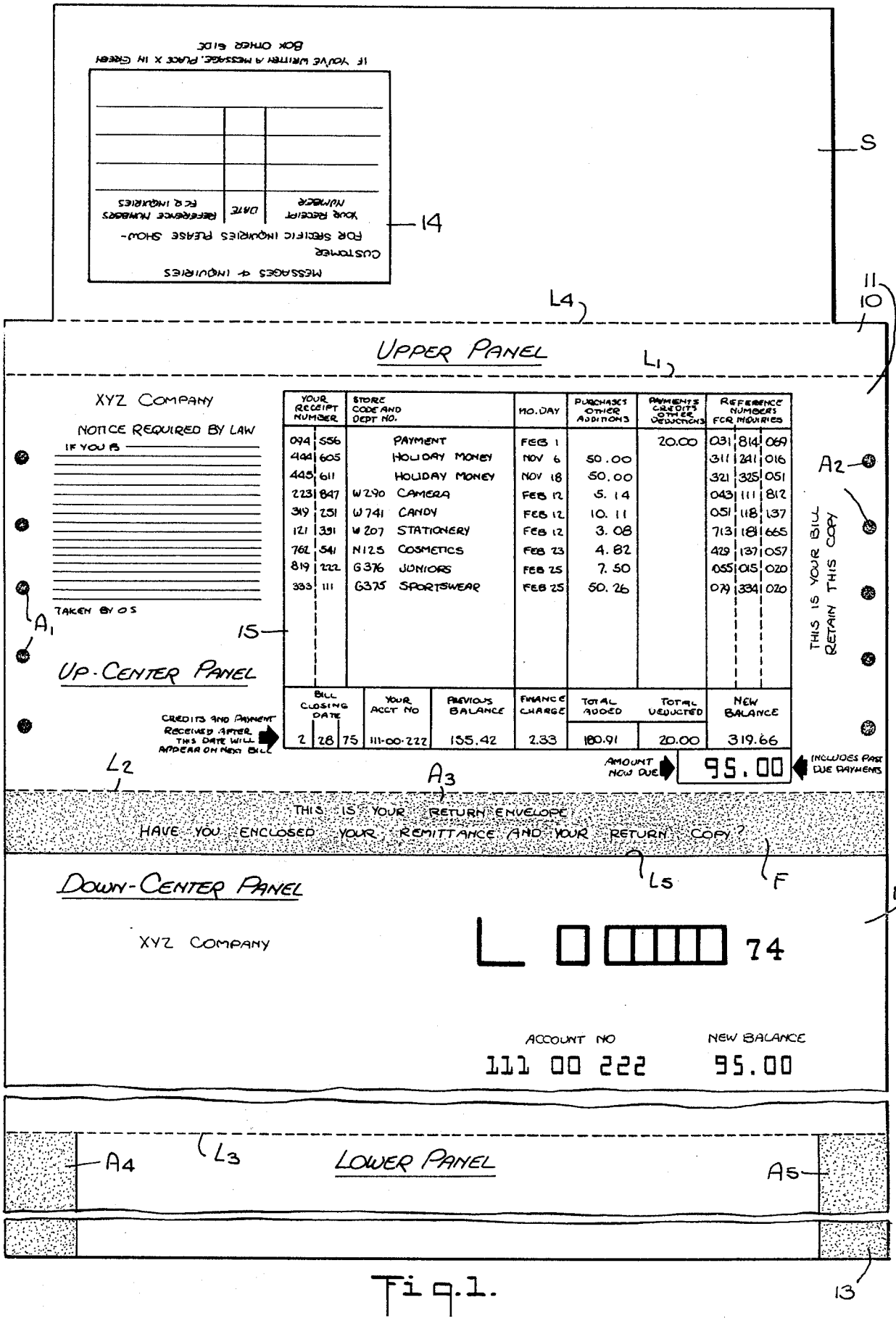

| YOUR RECEIPT NUMBER | | STORE CODE AND DEPT NO. | | MO. DAY | PURCHASES OTHER ADDITIONS | PAYMENTS CREDITS OTHER DEDUCTIONS | REFERENCE NUMBERS FOR INQUIRIES | | |
|---|---|---|---|---|---|---|---|---|---|
| 094 | 556 | | PAYMENT | FEB 1 | | 20.00 | 031 | 814 | 069 |
| 444 | 605 | | HOLIDAY MONEY | NOV 6 | 50.00 | | 311 | 241 | 016 |
| 445 | 611 | | HOLIDAY MONEY | NOV 18 | 50.00 | | 321 | 335 | 051 |
| 223 | 847 | W290 | CAMERA | FEB 12 | 5.14 | | 043 | 111 | 812 |
| 319 | 251 | W741 | CANDY | FEB 12 | 10.11 | | 051 | 118 | 137 |
| 121 | 391 | W207 | STATIONERY | FEB 12 | 3.08 | | 713 | 181 | 665 |
| 762 | 541 | N125 | COSMETICS | FEB 23 | 4.82 | | 429 | 137 | 057 |
| 819 | 222 | G376 | JUNIORS | FEB 25 | 7.50 | | 055 | 015 | 020 |
| 333 | 111 | G375 | SPORTSWEAR | FEB 25 | 50.26 | | 079 | 334 | 020 |

| BILL CLOSING DATE | | | YOUR ACCT NO | PREVIOUS BALANCE | FINANCE CHARGE | TOTAL ADDED | TOTAL DEDUCTED | NEW BALANCE |
|---|---|---|---|---|---|---|---|---|
| 2 | 28 | 75 | 111-00-222 | 155.42 | 2.33 | 180.91 | 20.00 | 319.66 |

Fig. 1.

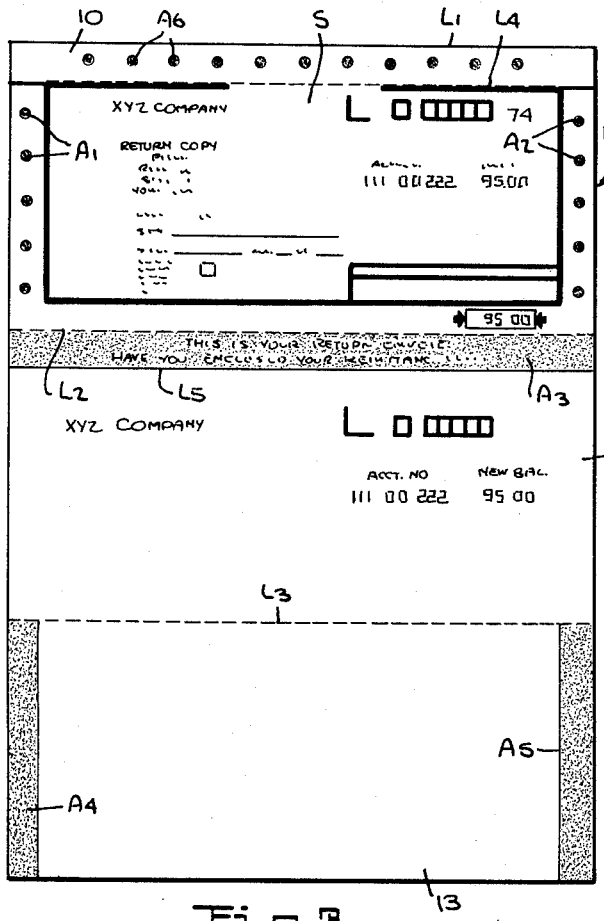
Fig. 3.
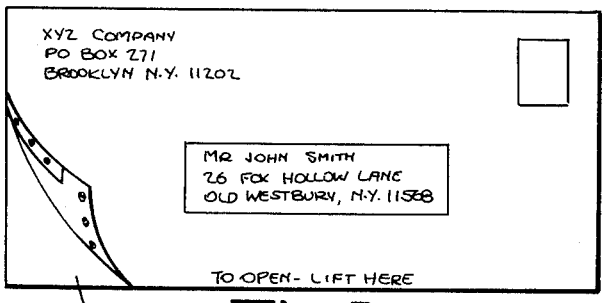
Fig. 5.
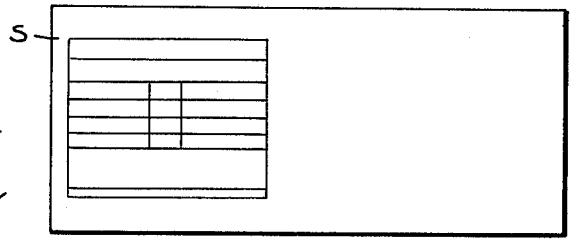
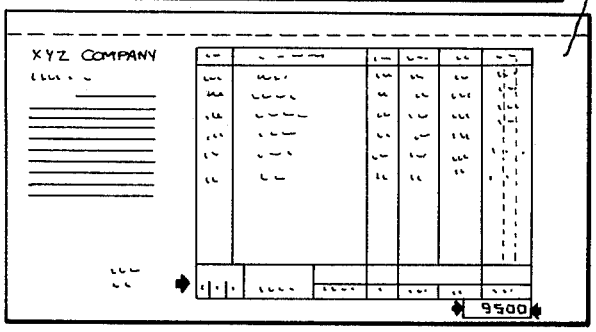
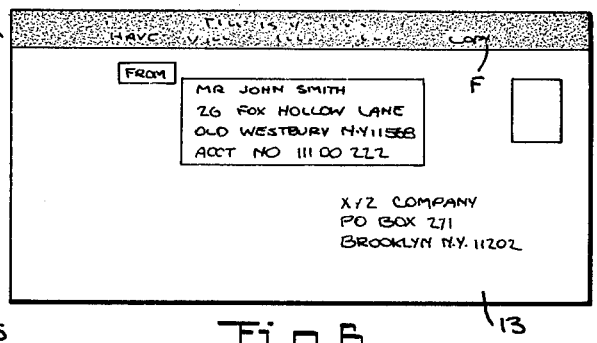
Fig. 6.
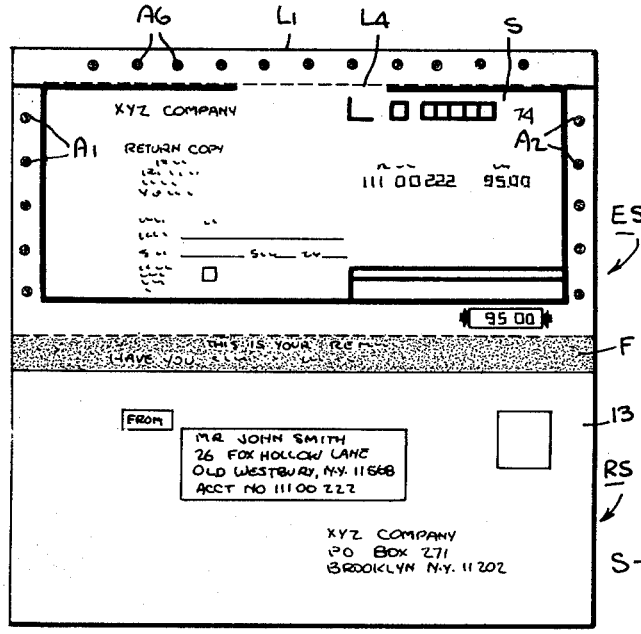
Fig. 4.
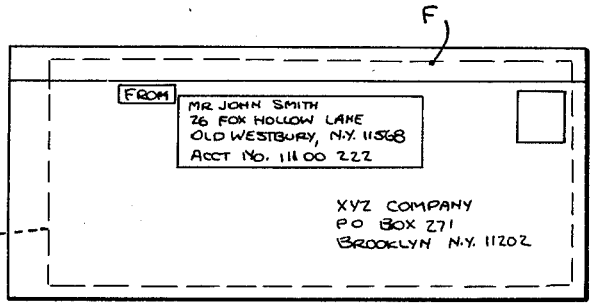
Fig. 7.

ONE PIECE, TWO-WAY MAILER

BACKGROUND OF INVENTION

This invention relates generally to two-way mailers making it possible for a company to forward to a customer a statement of charges and for the customer to remit, and more particularly to a one-piece, two-way mailer assembly constituted by a single blank which is formed into superposed panels that not only define the forwarding and return envelopes but also the statement and a return stub to accompany payment.

It is customary for a large company such as a telephone company, an electric power utility, a large department store, or for that matter any other commercial facility which sells goods or renders services to a multiplicity of customers, to bill each customer on a monthly or other periodic basis.

It has heretofore been the practice for the company to enclose a statement of charges in a forwarding envelope addressed to the customer. The statement is generally in the form of a card having a transverse perforation forming a stub identifying the account and the amount owing. Also inserted in this envelope is a return envelope for payment, as well as advertising folders and other types of material relating to the company's business. The customer receiving this pack of material is expected to send back his payment check and the stub section of the statement in the return envelope.

While the preparation of bills for customers and the addressing of the forwarding envelopes are now carried out by high-speed computer techniques, it has heretofore been necessary to employ special machines for stuffing the forwarding envelope with the statement of charges, the return envelope and the other material forming the pack. This is not only a time-consuming and costly operation, but because of machine or human error, it gives rise to troublesome mistakes. One may, however, minimize the possibility of inserting a statement intended for one customer in an envelope addressed to another customer by printing his address on the bill itself and inserting the bill with the address exposed in a window-type envelope. But such envelopes are more costly than ordinary envelopes and machine insertion is still required.

In order to avoid the need for separate forwarding and return envelopes, it is known to provide convertible envelopes which carry out both functions, such as those disclosed in the following patents: Nos. 2,759,658; 2,887,944; 3,184,150 and 3,111,336. But the making of envelopes of this type cannot be carried out on a low-cost, continuous basis. Moreover, it is still necessary with such envelopes to separately prepare and insert the statement of charges.

With a statement in card form of the type heretofore known, only a limited amount of space is available in which to list the charges, for a portion of the card is reserved for use as a return stub. In some instances, therefore, the charge space is inadequate, and it becomes necessary to annex a second statement to complete the charges. Special handling is required in these situations, and this adds to the cost of billing.

SUMMARY OF INVENTION

In view of the foregoing, the main object of this invention is to provide a two-way mailer assembly created from a single rectangular paper blank that is indented, perforated and folded to create four superposed panels defining a forwarding envelope and return envelope as well as a statement of charges, a return stub and a duplicate return stub, the components of the assembly being separable from each other.

A significant feature of the invention is that the statement of charges for the customer and the stub to be sent back to the company are not separate inserts but form components of the assembly that are severable therefrom by the receiving customer, the customer retaining the statement and inserting the return stub and his remittance in the return envelope.

Also an object of the invention is to provide a two-way mailer assembly formed from a single blank that may be manufactured in continuous web form in conjunction with computer techniques for imprinting the customer addresses, the statement of charges, and all other necessary data. An assembly-forming blank in accordance with the invention lends itself to addressing, as well as the imprinting of billing and record data by a computer-controlled, direct-image printing ink-jet transfer system.

Another advantage of the invention is that the assembly includes a panel for setting out the list of charges which is separate from another panel containing a return record stub, thus making far more space available for charging purposes than with conventional bills of the card type.

Briefly stated, these objects are attained in a two-way mailer assembly formed from a single rectangular blank of paper divided by transverse lines of perforation into an upper panel and up-center panel, a down-center panel and a lower panel, the side margins of the upper panel being indented to form a return stub.

The indented upper panel is folded over the up-center panel to form a forwarding section wherein the side margins of the front face of the up-center panel are exposed, this front face carrying a statement of charges, the rear face thereof bearing the customer's address. The front face of the upper panel stub serves as a message zone and the rear face thereof as a record to accompany payment.

The lower panel is folded over the down-center panel to form a return section in which the side margins of the lower panel are adhered to the down-center panel to define a return envelope for receiving the return stub and the customer's remittance. The front face of the down-center panel serves as a duplicate record, whereas the rear face of the lower panel carries the company's address.

The assembly is placed in condition for mailing to a customer by folding the forwarding section thereof over the return section and temporarily securing it thereto, whereby when a customer receives the assembly he may unfold the forwarding section and separate it from the return section and then sever the return stub from the statement and place this stub and a remittance in the return section envelope for mailing to the company.

Upon receipt of the return envelope by the company, the company, should it find that the customer has inadvertently omitted the return stub, he may then sever the lower panel containing the duplicate record from the envelope.

OUTLINE OF DRAWINGS

For a better understanding of the invention as well as other objects and further features thereof, reference is made to the following detailed description to be read in conjunction with the accompanying drawings, wherein:

FIG. 1 is a front face view of a blank for forming a two-way mailer assembly in accordance with the invention;

FIG. 3 shows the first folding step in creating the assembly;

FIG. 4 shows the second folding step in creating the assembly;

FIG. 5 shows the third and final step in forming the assembly, the assembly now being in condition for mailing by the company to the customer;

FIG. 6 shows the assembly received by a customer, after the customer has separated the forwarding section of the assembly from the return section thereof and severed the return stub from the statement; and FIG. 7 illustrates the return envelope in condition for mailing to the company.

DESCRIPTION OF INVENTION

The Blank (Front Face)

Figure 2:
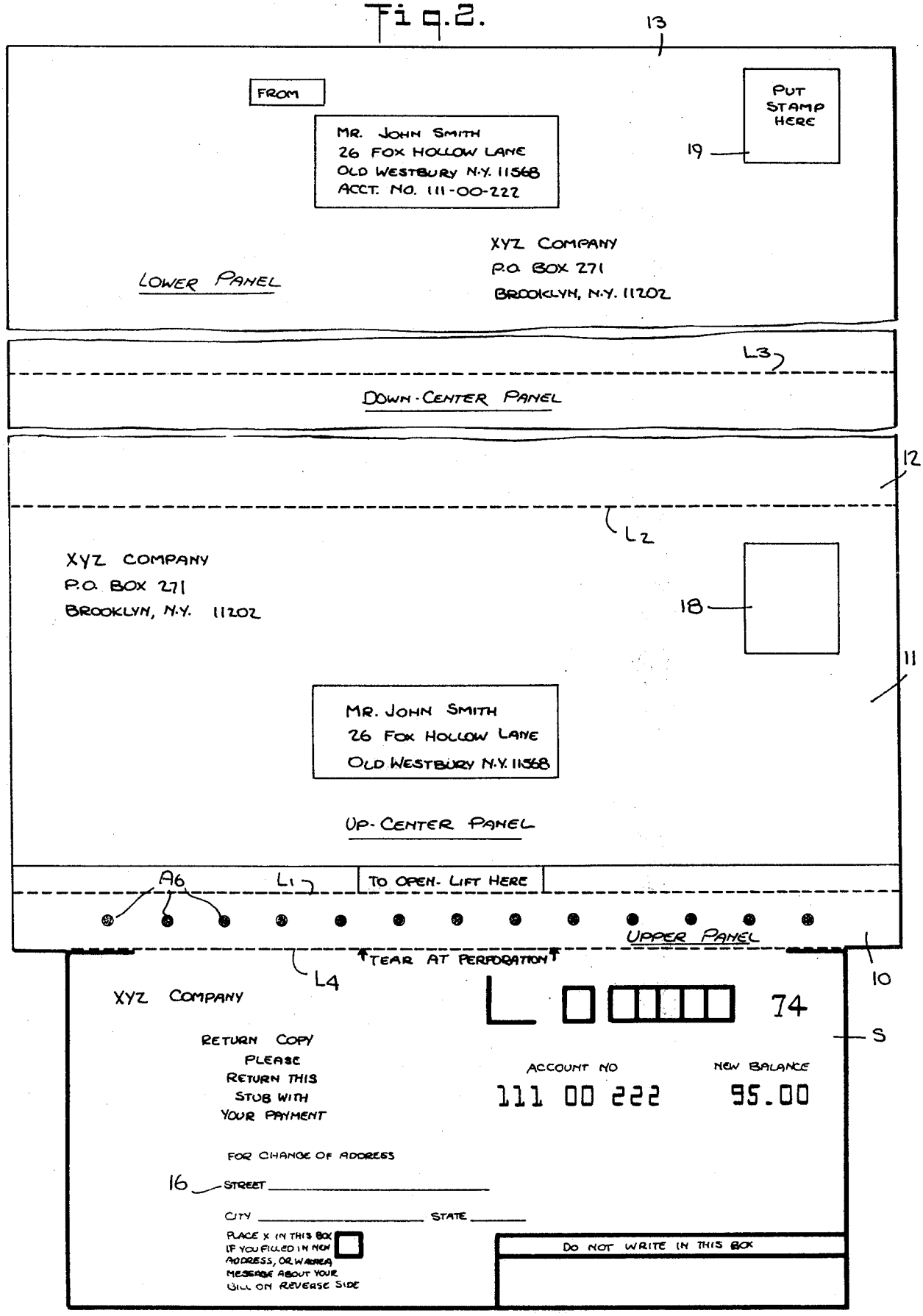
FIG. 2 is a rear face view of the same blank.

Referring now to FIG. 1, it will be seen that the front face of a blank in accordance with the invention is formed by a rectangular sheet of paper which is intended, perforated and printed, some of the printed matter being of the standard press type and the remaining printed matter representing computer entries. We shall, by way of example, assume that the two-way mailer assembly is intended for billing customers of the X-Y-Z Company and that one of these customers is John Smith.

In practice, this blank is formed by cutting into individual sheets a continuous web of paper which has been repeat-printed on a conventional rotary press to provide all of the permanent data appropriate to the two-way mailer, such as the name and address of the company, the statement form onto which the charges are to be entered and notices required by law, for such permanent data is common to all assemblies. All other data specific to individual customers is preferably entered, as will be later explained, by a computer-controlled ink jet technique.

The paper web from which the blank is cut is perforated and indented on the press and adhesive bands and spots applied thereto at selected areas. Each blank is provided with three transverse lines $L_1$, $L_2$, $L_3$ of perforations at parallel positions, thereby dividing the blank into four distinct panels 10, 11, 12 and 13, which are severable from each other.

Line $L_2$ is approximately at the midpoint of the blank and panel 11 above this line is therefore referred to as the up-center panel, while panel 12 below this line is designated the down-center panel. Panel 10 above up-center panel 11 is referred to as the upper panel, while panel 13 under down-center panel 12 is identified as the lower panel.

Upper panel 10 is provided with a line of perforations $L_4$, which is parallel to line $L_1$, and the side margins of this panel extending to line $L_4$ are indended by die-cutting to create a stub S which may be severed from upper panel 10.

The front face of stub S has printed thereon a block form 14 entitled "Message and Inquiries" within which a customer may identify items being questioned. The blank space adjacent block 14 permits the customer to write a message to the company, for stub S is returned by the customer to the company to accompany payment.

The front face of up-center panel 11 has printed thereon a statement form 15 into which the various charges to be billed to the customer are entered and the amount now due indicated. Adjacent form 15 is a notice required by law regarding errors made in statements. Obviously, the nature of the printed material appearing on the front face of up-center panel 11 depends on the type of business being conducted by the X-Y-Z Company. For purposes of illustration, we are assuming that this company is a retail department store and that the statement lists the items purchased by the customer and their prices.

Down-center panel 12 constitutes a duplicate record form of the transaction and entered thereon is the customer's account number and the new balance which is the amount the customer must pay the company. The original record form containing the same data is on the rear side of stub S, as will be later explained. The front face of lower panel 13 is unused, for it constitutes the back of the top ply of the forwarding envelope, as will later become apparent.

On either side margin of the up-center panel 11 there is a row of adhesive spots, row $A_1$ being on one side and row $A_2$ on the other. A band of adhesive $A_3$ is applied across the upper end of panel 12 between the line of perforations $L_2$ and an unperforated line $L_5$ printed parallel thereto to demarcate the flap F of the return envelope.

Applied to the marginal sides on the front face of lower panel 13 are bands of adhesive $A_4$ and $A_5$. The adhesive is preferably of the hot-melt type and is applied in liquid form to the front face of the sheet. The adhesive in band form serves to provide a bond which is more or less permanent and not easily disrupted, whereas the adhesive spots which have unbonded spaces therebetween form a temporary bond which is more easily disrupted.

Blank (Rear Face)

Referring now to FIG. 2 showing the rear face of the blank, it will be seen that return stub S on upper panel 10 constitutes the original record of payment and contains the customer's account number and his new balance. When the assembly is received by a customer and unfolded, this sheet is severed along perforations $L_4$ from the upper panel 10 and is returned to the company by the customer to accompany payment. The original return stub also contains a form 16 to indicate a change of address and a box 17 which can be checked by the customer to call attention to the fact that he has written a message on the message side of the return stub.

In the space between perforation line $L_1$ to $L_4$ on upper panel 10 on the rear face thereof is a row $A_6$ of spot adhesive. The rear face of up-center panel 11, which is the front of the completed assembly which is forwarded to the customer, has printed thereon the name and address of customer John Smith and has a space 18 for a stamp.

The rear face of down-center panel 12 is unused, for this face is the back of the completed assembly. The rear face of lower panel 13 has printed thereon the name and address of the X-Y-Z Company and has a space 19 for a stamp.

Ink Jet Printing

The billing and record data appropriate to the customer is preferably entered on the sheet by a Mead "Dijit" image system or an equivalent system involving direct imaging by an ink-jet system controllable by a computer. This is effected by an array of hundreds of individually controlled ink jets, each capable of generating thousands of uniformly spaced ink droplets per second. At the direction of a computer, the droplets are given an electrical charge or left in the neutral state. All droplets then pass through a high-voltage deflection field that allows the neutral droplets to pass through to the paper web advancing therebelow to form a portion of a letter, number or other graphic image, the charged droplets being deflected and returned to the ink reservoir.

A computer for controlling the ink-jet imaging system may include a multi-channel compatible magnetic tape on which is recorded the desired billing and customer addressing information to be imprinted on both sides of the individual blanks.

In practice, the information which is common to all customers is printed by conventional techniques on a continuous web basis, such as the company's address and the forms into which entries are to be made, whereas the data which is unique to each customer is printed by the ink-jet technique after the printed web has been cut into individual blanks.

Since data specific to any given customer is entered on both sides of the blank, it is necessary to pass the paper sheet twice through the ink jet system, and the control system therefor must ensure proper coordination of the front face and rear face entries, so that all imprinted information relates to the same customer. Alternatively, one ink jet system may be used to make entries on the front face and a separate system to make entries on the rear face.

First Step in Assembly

As shown in FIG. 3, the first step in converting the blank into a two-way mailer involves folding the upper panel 10 over the up-center panel 11 to form a forwarding section FS. Because of the indentation in upper panel 10, the rows of spot adhesive $A_1$ and $A_2$ on the front face of the up-center panel are exposed and do not engage the sides of stub S.

The forwarding section includes the statement of charges and the return stub. Thus the customer, upon receiving the assembly, is free to tear off the stub along the line of perforations $L_4$ and to return the stub to the company, the customer retaining the statement.

Second Step in Assembly

As shown in FIG. 4, the second step in converting the blank into a two-way mailer involves folding lower panel 13 over down-center panel 12 on the line of perforations $L_3$. The upper end of the folded-over lower panel registers with line $L_5$ on the exposed envelope flap F to form a return section RS.

Because of adhesive bands $A_4$ and $A_5$ (FIG. 1) on the front face of lower panel 13, the side margins of the folded-over lower panel are adhered to the front face of down-center panel 12 for form a return envelope addressed to the company, into which envelope the customer inserts stub S and a payment check.

As shown in FIG. 5, the third and final step in completing the assembly involves folding forwarding section FS over return section RS.

As a consequence of this folding step, the rows of spot adhesive $A_1$ and $A_2$ on the exposed side margins of up-center panel 11 adhere to the corresponding side margins on the rear face of lower panel 13 and the row of spot adhesive $A_6$ at the end of upper panel 10 adheres to the corresponding end margin of lower panel 13, thereby temporarily bonding the folded-over forwarding section FS to the return section RS and sealing the assembly.

In practice, before the forwarding section is bonded to the return section, one may insert in the folds formed by these two sections advertising slips or other promotional inserts and notices.

Thus in the completed assembly, the address of the customer appears on the front thereof and it may therefore be mailed to him in the usual fashion.

Action Taken by Customer

When the customer receives the two-way mailer assembly sent to him by the company, he breaks the temporary seal and unfolds the two sections. He then severs the forwarding section FS from the return section RS on the line of perforations $L_2$, thereby separating the return envelope from the statement of charges and the return stub S, as shown in FIG. 6.

The return stub is severed from the statement which is retained by the customer, and the customer then inserts the return stub with a payment check in the return envelope. He then folds and seals flap F, as shown in FIG. 7, and mails the return envelope to the company.

Action Taken by Company

When the company clerk receives the return envelope, he removes the check and the return stub therefrom. The return stub constitutes a record of the customer's payment, which may be read into a computer system capable of scanning the indicia contained on the stub.

However, in the event the customer has failed to insert the record stub in the return envelope, the clerk tears apart the return envelope to recover the duplicate record therefrom, which he then uses in place of the missing stub.

Thus a two-way mailer assembly according to the invention provides a mailing piece which includes a statement of charges, a record stub and a return envelope, the envelope incorporating a duplicate record which is useful should the customer forget to return the stub. This represents an important advantage of the invention, for in conventional billing operations, should the customer send in a check for payment which is not accompanied by a record stub, then special handling is required. And since the two way mailer includes a duplicate record as well as a record stub, in some billing situations one may omit from the blank the upper panel and the record stub S included therein, and rely on the record contained in the return envelope so that the customer is not required to enclose a stub in the return envelope.

While there has been shown and described a preferred embodiment of a one-piece, two-way mailer in accordance with the invention, it will be appreciated that many changes and modifications may be made therein without, however, departing from the essential spirit thereof. For example, where one only requires a one-way mailer to send a statement to a customer accompanied by a check, one may omit the lower panel and the return envelope formed thereby.

I claim:

1. A one-piece, two-way mailer assembly making it possible for a company to send a charge statement to a customer and for the customer to mail back a remittance; said assembly being formed by a single rectangular sheet of paper having a front face and a rear face and comprising:

A. an upper panel, an up-center panel, a down-center panel and a lower panel defined by transverse lines of perforations on said sheet;

B. said upper panel having its side margins indented to form a record stub which is severable from said upper panel by a line of perforations, said upper panel being folded over said up-center panel to form a forwarding section in which said up-center panel carries said statement on its front face;

C. said lower panel being folded over the down-center panel to form a return section, the side margins of the foldedover lower panel being bonded to said down-center panel to define an envelope for receiving said record stub and said remittance;

D. said forwarding section being folded over said return section and being temporarily marginally bonded thereto to complete said assembly.

2. An assembly as set forth in claim 1, wherein the line of perforations from which said stub is severable from said upper panel is parallel to the line of perforations dividing said upper panel from said up-center panel, the space between these lines having a row of spot adhesive thereon to effect a temporary bond when the forwarding section is folded over the return section.

3. An assembly as set forth in claim 1, wherein the side margins of the up-center panel which are exposed when the stub is folded thereover have respective rows of spot adhesive thereon to effect a temporary bond when the forwarding section is folded over the return section.

4. An assembly as set forth in claim 1, wherein the front face of said stub has a printed block thereon by which inquiries may be made by the customer.

5. An assembly as set forth in claim 4, wherein the rear face of said stub contains a printed record identifying the customer's account and the amount due to the company.

6. An assembly as set forth in claim 5, wherein said down-center panel contains a record duplicating that contained on the stub.

7. An assembly as set forth in claim 1, wherein the rear face of the lower panel is addressed to the company.

8. An assembly as set forth in claim 1, wherein the rear face of the up-center panel is addressed to the customer.

9. An assembly as set forth in claim 1, wherein said statement is printed by a computer-controlled ink-jet system.

* * * * *